US006079713A

United States Patent [19]

Paz

[11] Patent Number: 6,079,713

[45] Date of Patent: Jun. 27, 2000

[54] METHOD OF PLAYING A GAME OF CHANCE

[76] Inventor: Jesse J. Paz, 1204 Hartview Ave., Valinda, Calif. 91744

[21] Appl. No.: 09/007,023

[22] Filed: Jan. 14, 1998

[51] Int. Cl.[7] ..... A63F 1/00

[52] U.S. Cl. ..... 273/292

[58] Field of Search ..... 273/246, 292, 273/239

[56] References Cited

U.S. PATENT DOCUMENTS

| | | | |
|---|---|---|---|
| 1,463,871 | 8/1923 | Chisolm | 273/246 |
| 2,022,533 | 11/1935 | Blank | 273/246 |
| 2,062,168 | 11/1936 | Entwistle | 273/246 |
| 5,398,938 | 3/1995 | Money | 273/237 |

OTHER PUBLICATIONS

"Horse Race", Scarne's Encyclopedia of Games by John Scarne, Harper & Row Publishers, pp. 314, 315, 1973.

*Primary Examiner*—Benjamin H. Layno

[57] ABSTRACT

A method of playing a game of chance is disclosed which allows players to place bets on the occurrence of any of a plurality of events. The occurrence of each event cannot be controlled or influenced by the player and cannot be predicted. A player betting on an occurrence that four cards of a particular suit will be dealt by a dealer before any four cards of any other suit are dealt is paid at true odds of 3–1 upon occurrence of the event. Other bet options yield other odds.

15 Claims, 1 Drawing Sheet

METHOD OF PLAYING A GAME OF CHANCE

BACKGROUND OF THE INVENTION

1. Field of the Invention

The present invention relates generally to games and, more particularly, to games of chance using decks of playing pieces.

2. Description of Related Art

Card games have existed where each player is dealt a number of cards and then has an option of receiving additional cards. Common objects of typical card games are for each player to accumulate a desired collection of cards. The inventor is unaware of any games which utilize playing pieces and which simulate in some ways the action of a horse race.

SUMMARY OF THE INVENTION

A method of playing a game of chance is disclosed which allows players to place bets on the occurrence of any of a plurality of events. The occurrence of each event cannot be controlled or influenced by the player and cannot be predicted. A player betting on an occurrence that four cards of a particular suit will be dealt by a dealer before any four cards of any other suit are dealt is paid at true odds of 3–1 upon occurrence of the event. Other bet options yield other odds.

The present invention, together with additional features and advantages thereof, may best be understood by reference to the following description taken in connection with the accompanying illustrative drawings.

DETAILED DESCRIPTION OF THE PREFERRED EMBODIMENT

Figure 1:
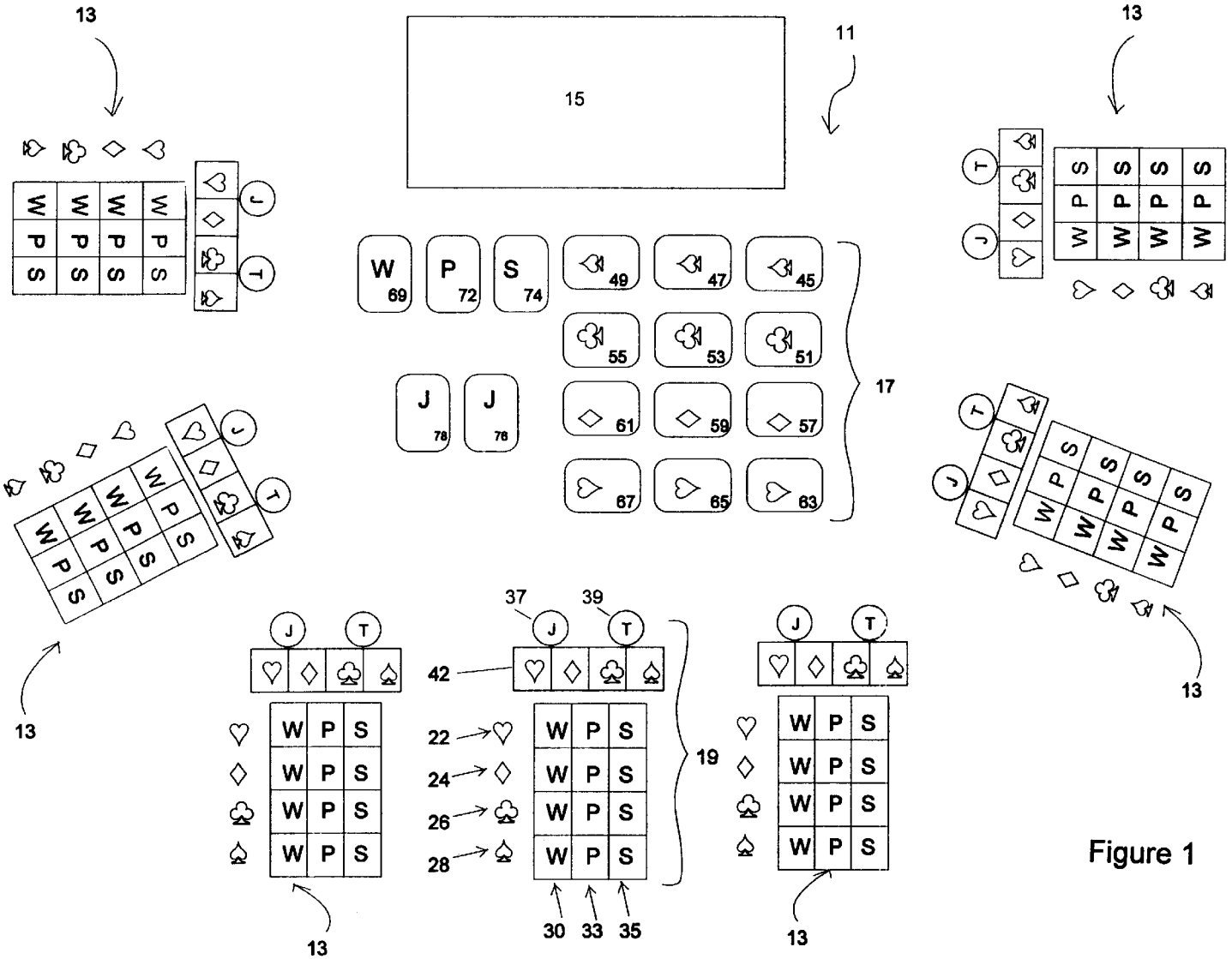
FIG. 1 illustrates the preferred layout of the table of the present invention which is used in connection with the method of the present invention.

Referring more particularly to the drawing, FIG. 1 illustrates a playing surface 11 in accordance with the presently preferred embodiment. The playing surface 11 preferably comprises seven player positions 13 and a dealer position 15. The player positions 13 and the dealer position 15 are all disposed around a playing field 17.

Each player position 13 comprises a betting template 19. Each betting template 19 comprises a Heart row 22, a Diamond row 24, a Club row 26, and a Spade row 28. Each betting template 19 further comprises a win column 30, a place column 33, and a show column 35. The four rows 22, 24, 26 and 28, respectively, and the three columns 30, 33 and 35, respectively, form a matrix having twelve bet positions. A player can place one or more tokens on one or more of the twelve wager positions to indicate the player's bet. For example, a player placing a token on the upper right wager position, corresponding to the Heart row 22 and the show column 35, bets that the Hearts suit will "show," as described below.

The betting template 19 further comprises a Joker betting area 37, a Trifecta betting area 39, and a Trifecta layout matrix 42. A player betting on Jokers places a token in the Joker betting area 37. A player betting on Trifecta places a token in the Trifecta betting area 39, and also places three indicator tokens (not shown) in the Trifecta layout matrix 42.

A first indicator token will indicate a "win," a second indicator token will indicate a "place," and a third indicator token will indicate a "show." The player places the three indicator tokens in the Trifecta layout matrix 42 to indicate the player's bet of the three suits which the player believes will obtain the win, place, and show statuses.

The playing field 17 comprises a first Spade position 45, a second Spade position 47, and a third Spade position 49. The playing field 17 further comprises a first Club position 51, a second Club position 53, and a third Club position 55, and further comprises a first Diamond position 57, a second Diamond position 59, and a third Diamond position 61. The playing field 17 further comprises a first Heart position 63, a second Heart position 65, and a third Heart position 67. A win position 69, a place position 72, and a show position 74 are disposed to the dealer's right of the positions 45, 57, 49, 51, 53, 55, 57, 59, 61, 63, 65 and 67. The playing field 17 further comprises a first Joker position 76 and a second Joker position 78.

The method of the present invention is preferably implemented on a standard Twenty-One Table. The dealer at the dealer position 15 controls the game but does not compete against the players. In the presently preferred embodiment, the method comprises a casino-banked game, which uses a single deck of poker-style cards comprising fifty-two suit cards and two Joker cards. In alternative embodiments of the present invention, other numbers of cards or decks of cards or playing pieces may be used.

The method of the present invention is in some ways analogous to a race. Each player can place one or more bets in the betting template 19 to indicate the player's bet on the card suit which will first be drawn four times to "win," the card suit which will subsequently be drawn four times to "place," and the card suit which will finally be drawing four times to "show." Players may bet on one or two or all three of the suits. For example, a player may bet on the proposition that the Hearts suit will win. Alternatively, a player may bet on all three propositions by betting, for example, that the Spades suit will win, that the Diamond suit will place, and that the Hearts suit will show. Each proposition pays off at 3-to-1 odds. Unlike a pari-mutual betting system, a player who has a "place" bet on a suit does not win if the suit earns a "win." Similarly, players who have a show bet on a suit do not win if the suit earns a win or a place. The suit must finish in the position which the bet specifies. In alternative embodiments, other ranking schemes may be implemented.

In accordance with the method of the present invention, players can also bet on a Trifecta, which proposition indicates the exact order in which the three suits will finish the race in win, place, and show positions. The Trifecta bet plays off at 23-to-1 odds. In the presently preferred embodiment where Joker cards are used, the two Jokers serve as a fifth suit. In an event where the two Joker cards are drawn from the deck before any other suit has attained a win, the House wins all of the wagers on the table. The players, however, may also bet on the Joker suit, which is paid off at 27-1 odds.

In accordance with the method of the present invention, the dealer begins dealing cards face-up from a shuffled deck of cards, after all wagers are in place on the betting templates 19 of the respective players. The dealer draws cards from the deck, one card at a time, and places the cards, beginning at the dealer's left, in the respective positions in the playing field. The first Heart that is drawn, for example, is placed in the first Heart position 63. The second Heart card that is drawn from the deck is placed in the second Heart position 65, and the third Heart card that is drawn from the deck is placed in the third Heart position 67. Additionally, when Joker cards are used, the first Joker card drawn from the deck is placed in the first Joker position 76, and the second Joker card drawn from the deck is placed in the second Joker position 78.

As cards are drawn from the deck and placed in their respective positions in the playing field 17, according to their suits, the card suit having more cards drawn in that suit will progress faster through the first, second, and third positions from the dealer's left to the dealer's right.

As an example of the game play, if a very first card dealt from the deck is a Club card, then this first card is placed in the first Club position 51. If a second card dealt from the deck is a Diamond card, then the second card is placed in the first Diamond position 57. If a third card dealt from the deck is a Heart card, then this card is placed in the first Heart position 63. If a fourth card dealt from the deck is also a Heart card, then this fourth card is placed in the second Heart position 65. If a fifth card dealt from the deck is a Diamond card, then this fifth card is placed in the second Diamond position 59. If a sixth card dealt from the deck is also a Diamond card, then the sixth card is placed in the third Diamond position 61. If, by chance, the seventh card drawn from the deck is also a Diamond card, then this seventh card would be placed in the win position 69. Accordingly, the Diamond suit would obtain the win status. The win status indicates, in this example, that the Diamond suit is the first suit to be exposed four times during the game play.

After a win status occurs for a given suit, indicating that the suit has first been exposed four times before any other suit, and the fourth card having the winning suit is placed in the win position 69, the dealer continues to draw cards and to place the cards in the playing field 17 until a second suit has been exposed four times. The fourth card of the second suit is placed in the place position 72. As the game play continues, cards which are drawn having the win suit are placed in the win position 69, and cards which are drawn having the place suit are placed in the place position 72. Other cards are placed in open spaces on the playing field 17, according to their suit, until a third suit is exposed four times. The fourth card that is dealt of this third suit is placed in the show position 74. Joker cards, which are dealt after the placement of a card in the win position 69, are not meaningful, but are placed in their appropriate positions 76, 78 if drawn.

If two Joker cards are drawn before any four cards of a particular suit are drawn, then the game ends and the House wins, in addition to any player that has bet on this Joker proposition, who also wins. Generally, the game ends after either a card is placed in the show position 74, unless two Joker cards are dealt before a card is placed in the win position 69.

The occurrence of two Joker cards being dealt before a card is placed in the win position 69 ends the game. After the game play has ended, the dealer collects the cards in the playing field 17, with the exception of the cards in the win position 69, the place position 72, the show position 74, the first Joker position 76, and the second Joker position 78. The dealer then collects and pays tokens to the various players in accordance with the outcome of the game and the players respective bets. The dealer next collects the remaining cards from the playing field 17 and shuffles the cards for another round of play. Two detailed examples of game play are provided below:

EXAMPLE 1

Player 1 Bets Diamonds to Win, Spades to Place.
Player 2 Bets Clubs to Win, Hearts to Show.
Player 3 Bets Hearts to Win, Clubs to Place, Spades to Show.
Player 4 Bets Clubs to Place. Also places optional bet on the House.
Player 5 Bets Diamonds to Win. Also places optional Trifecta bet, Diamonds to Win, Clubs to Place, Spades to Show.
Player 6 Bets Diamonds to Win, Hearts to Place.
Player 7 Bets Diamonds to Win, Clubs to Place, Spades to Show.

In this race assume: Diamonds Win, Clubs Place, Spades Show.

Player 1 Collects on the Win bet, loses the Place bet.
Player 2 Loses both the Win and Show bets.
Player 3 Loses the Win bet, collects on the Place and Show bets.
Player 4 Collects on the Place bet, loses the House bet.
Player 5 Collects the Win bet. Also collects on the Trifecta bet.
Player 6 Collects on the Win, loses the Place bet.
Player 7 Collects on the Win, Place and Show bets.
Note: Above Win, Place And Show bet payouts are 3-1. Trifecta payout 23-1.

EXAMPLE 2

Player 1 Bets Hearts to Win, Diamonds to Place.
Player 2 Bets Spades to Show. Also bets on Jokers, (House.)
Player 3 Bets Trifecta, (Diamonds to Win, Clubs to Place, Hearts to Show.) Also bets on Jokers.
Player 4 Bets Hearts and Clubs to Win.
Player 5 Bets Spades to Win, Diamonds to Show.
Player 6 Bets Jokers.
Player 7 Bets Diamonds to Win, Hearts to Show. Bets Trifecta, (Diamonds to Win, Clubs to Place, Hearts to Show.)

In this race assume: Jokers Win. In order for this to happen the two Jokers must be exposed prior to any suit attaining a Win.

Player 1 Loses Win and Place bets.
Player 2 Loses Show bet. Collects on Joker bet.
Player 3 Loses Trifecta bet. Collects on Joker bet.
Player 4 Loses both Win bets.
Player 5 Loses Win and Show bets.
Player 6 Collects on Joker bet.
Player 7 Loses Win and Show bets. Loses Trifecta bet.
Note: Joker bet payout is 27-1.

In accordance with the presently preferred embodiment, the win, place, and show propositions are each paid at true odds of 3-1. The House advantage is derived solely from the House wins when the two Jokers are drawn before the occurrence of a suit win event. The frequency of both Jokers being drawn first has been determined by simulating 2 million games of the present invention using a computer. In this computer simulation, the House won 67,989 times out of the 2 million games, which corresponds a win percentage of approximately 3.4%. The "vig" of 3.4% on the proposition of two Jokers being drawn first is competitive with other casino table games. The House Advantage on the proposition that both Jokers will be drawn before a suit win occurs is derived from the same figure. If 1,000 games are played and the House wins 34 of the games, players on that proposition will be paid 34×28, which is 952 bet units, yielding the House a vig of 4.8%. The Trifecta is paid at 23-1, which is in accordance with true odds, since twenty-four unique sequences can be created with four suits and each unique sequence is equally likely to win. The frequency of House Wins determines the vig in this instance as well. Accordingly, the 3.4% figure is the vig on the Trifecta proposition.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

I claim:

1. A method of playing a game of chance among a plurality of players, the method comprising the following steps:

(a) providing a set of playing pieces, the set of playing pieces comprising a number of first playing pieces each of said first playing pieces having a first suit, a number of second playing pieces each of said second playing pieces having a second suit, a number of third playing pieces each of said third playing pieces having a third suit, and a number of fourth playing pieces each of said fourth playing pieces having a fourth suit, each of said suits being distinguishable from each other, and each suit having an equal number of playing pieces;

(b) placing at least one wager by each of the plurality of players, each wager of each player corresponding to at least one of:

(1) a first scenario wherein a win occurs if a first predetermined number, which is greater than one, of the first playing pieces is dealt by a dealer before a second predetermined number of the second playing pieces is dealt by the dealer; and (2) a second scenario wherein a win occurs if the second predetermined number, which is greater than one, of the second playing pieces is dealt by the dealer before the first predetermined number of the first playing pieces is dealt by the dealer;

(c) dealing by the dealer at least one playing piece from the set of playing pieces;

(d) determining whether the first predetermined number of first playing pieces has been dealt by the dealer;

(e) determining whether the second predetermined number of second playing pieces has been dealt by the dealer;

(f) repeating steps (c) through (e) until either the first predetermined number of first pieces has been dealt by the dealer or the second predetermined number of second playing pieces has been dealt by the dealer.

2. The method of playing a game of chance as recited in claim 1, wherein the step of providing a set of playing pieces comprises a step of providing a set of playing cards, and 2 Joker cards.

3. The method of playing a game of chance as recited in claim 1, wherein the step of placing at least one wager by each of the plurality of players comprises a step of placing at least one wager by each of the plurality of players wherein each wager of each player further corresponds to at least one of:

(3) a third scenario wherein a win occurs if a third predetermined number of the third playing pieces is dealt by the dealer before the first predetermined number of the first playing pieces is dealt by the dealer, before the second predetermined number of the second playing pieces is dealt by the dealer, and before a fourth predetermined number of the fourth playing pieces is dealt by the dealer; and (4) a fourth scenario wherein a win occurs if the fourth predetermined number of the fourth playing pieces is dealt by a dealer before the first predetermined number of the first playing pieces is dealt by the dealer, before the second predetermined number of the second playing pieces is dealt by the dealer, and before the third predetermined number of the third playing pieces is dealt by the dealer.

4. A method of playing a game of chance among a plurality of players, the method comprising the following steps:

(a) providing a set of playing pieces, the set of playing pieces comprising a number of first playing pieces each of said first playing pieces having a first suit, a number of second playing pieces each of said second playing pieces having a second suit, a number of third playing pieces each of said third playing pieces having a third suit, and a number of fourth playing pieces each of said fourth playing pieces having a fourth suit, each of said suits being distinguishable from each other, and each suit having an equal number of playing pieces;

(b) placing at least one wager by each of the plurality of players, each wager of each player corresponding to at least one of:

(1) a first scenario wherein a win occurs if a first predetermined number, which is greater than one, of the first playing pieces is dealt by a dealer before a second predetermined number, which is greater than one, of the second playing pieces is dealt by the dealer; and (2) a second scenario wherein a win occurs if the second predetermined number of the second playing pieces is dealt by the dealer before the first predetermined number of the first playing pieces is dealt by the dealer;

(c) dealing by the dealer a playing piece from the set of playing pieces, the playing piece being dealt by the dealer onto an area which is substantially centrally located among the plurality of players, and the playing piece being dealt by the dealer onto the area in an orientation to render an attribute of the playing piece discernible by each of the plurality of players;

(d) determining whether the first predetermined number of first playing pieces has been dealt by the dealer;

(e) determining whether the second predetermined number of second playing pieces has been dealt by the dealer;

(f) repeating steps (c) through (e) until either the first predetermined number of first playing pieces has been dealt by the dealer or the second predetermined number of second playing pieces has been dealt by the dealer.

5. The method of playing a game of chance as recited in claim 4, wherein:

the step of placing at least one wager by each of the plurality of players comprises a step of placing at least one wager by each of the plurality of players wherein each wager of each player further corresponds to at least one of:

(3) a third scenario wherein a win occurs if a third predetermined number of the third playing pieces is dealt by the dealer before the first predetermined number of the first playing pieces is dealt by the dealer, before the second predetermined number of the second playing pieces is dealt by the dealer, and before a fourth predetermined number of the fourth playing pieces is dealt by the dealer; and (4) a fourth scenario wherein a win occurs if the fourth predetermined number of the fourth playing pieces is dealt by a dealer before the first predetermined number of the first playing pieces is dealt by the dealer, before the second predetermined number of the second playing pieces is dealt by the dealer, and before the third predetermined number of the third playing pieces is dealt by the dealer.

6. The method of playing a game of chance as recited in claim 5, wherein the step of providing a set of playing pieces comprises a step of providing a set of shuffled playing pieces, wherein the first playing pieces, the second playing pieces, the third playing pieces, and the fourth playing pieces are shuffled together in a substantially random order.

7. The method of playing a game of chance as recited in claim 6, further comprising an initial step of providing a table having a playing surface and a periphery, the plurality of players being arranged about the periphery, wherein the playing surface comprises playing piece receiving areas and wagering areas.

8. The method of playing a game of chance as recited in claim 7, wherein the set of playing pieces corresponds to a deck of cards.

9. A method of playing a game of chance among a plurality of players, the method comprising the following steps:

(a) providing a set of playing pieces, the set of playing pieces comprising a number of first playing pieces each of said first playing pieces having a first suit, a number of second playing pieces each of said second playing pieces having a second suit, a number of third playing pieces each of said third playing pieces having a third suit, and a number of fourth playing pieces each of said fourth playing pieces having a fourth suit, each of said suits being distinguishable from each other, and each suit having an equal number of playing pieces;

(b) placing at least one wager by each of the plurality of players, each wager of each player corresponding to at least one of:

(1) a first scenario wherein a win occurs if a first predetermined number, which is greater than one, of the first playing pieces is dealt by a dealer before a second predetermined number, which is greater than one, of the second playing pieces is dealt by the dealer and before a third predetermined number which is greater than one, of the third playing pieces is dealt by the dealer;

(2) a second scenario wherein a win occurs if the second predetermined number of the second playing pieces is dealt by a dealer before the first predetermined number of the first playing pieces is dealt by the dealer and before the third predetermined number of the third playing pieces is dealt by the dealer;

(3) a third scenario wherein a win occurs if the third predetermined number of the third playing pieces is dealt by a dealer before the first predetermined number of the first playing pieces is dealt by the dealer and before the second predetermined number of the second playing pieces is dealt by the dealer; and (4) a fourth scenario wherein a win occurs if the first predetermined number of the first playing pieces is dealt by a dealer before the second predetermined number of the second playing pieces is dealt by the dealer, and if the second predetermined number of the second playing pieces is dealt by the dealer before the third predetermined number of the third playing pieces is dealt by the dealer; and (c) dealing by the dealer at least one playing piece from the set of playing pieces;

(d) determining whether the first predetermined number of the first playing pieces has been dealt by the dealer;

(e) determining whether the second predetermined number of the second playing pieces has been dealt by the dealer;

(f) determining whether the third predetermined number of the third playing pieces has been dealt by the dealer;

(g) repeating steps (c) through (f) until either the first predetermined number of the first playing pieces has been dealt by the dealer, the second predetermined number of the second playing pieces has been dealt by the dealer, or the third predetermined number of the third playing pieces has been dealt by the dealer.

10. The method of playing a game of chance as recited in claim 9, wherein the step of placing at least one wager by each of the plurality of players comprises a step of placing at least one wager by each of the plurality of players, each wager of each player corresponding to at least one of:

(1) a first scenario wherein a win occurs if the first predetermined number of the first playing pieces is dealt by a dealer before the second predetermined number of the second playing pieces is dealt by the dealer, and before the third predetermined number of the third playing pieces is dealt by the dealer, and before a fourth predetermined number, which is greater than one, of the fourth playing pieces is dealt by the dealer;

(2) a second scenario wherein a win occurs if the second predetermined number of the second playing pieces is dealt by a dealer before the first predetermined number of the first playing pieces is dealt by the dealer, and before the third predetermined number of the third playing pieces is dealt by the dealer, and before the fourth predetermined number of the fourth playing pieces is dealt by the dealer;

(3) a third scenario wherein a win occurs if the third predetermined number of the third playing pieces is dealt by a dealer before the first predetermined number of the first playing pieces is dealt by the dealer, and before the second predetermined number of the second playing pieces is dealt by the dealer, and before the fourth predetermined number of the fourth playing pieces is dealt by the dealer; and (4) a fourth scenario wherein a win occurs if the fourth predetermined number of the fourth playing pieces is dealt by a dealer before the first predetermined number of the first playing pieces is dealt by the dealer, and before the second predetermined number of the second playing pieces is dealt by the dealer, and before the third predetermined number of the third playing pieces is dealt by the dealer.

11. The method of playing a game of chance as recited in claim 10, wherein the first predetermined number is four, the second predetermined number is four, the third predetermined number is four, and the fourth predetermined number is four.

12. The method of playing a game of chance as recited in claim 11, wherein the four suits of said set of playing pieces correspond to four suits of playing at least one deck of cards.

13. The method of playing a game of chance as recited in claim 12, wherein the step of dealing by the dealer at least one playing piece from the set of playing pieces comprises a step of placing the at least one playing piece in an area on a playing surface that corresponds to a suit of the playing piece, wherein playing pieces dealt by the dealer having different suits are placed in different areas on the playing surface.

14. The method of playing a game of chance as recited in claim 12, wherein the step of dealing by the dealer at least one playing piece from the set of playing pieces comprises a step of placing the at least one playing piece in an area on a playing surface that corresponds to a suit of the playing piece, the at least one playing piece being placed in the area on the playing surface in an orientation to facilitate a user to discern a suit of the at least one playing piece, wherein playing pieces dealt by the dealer having different suits are placed in different areas on the playing surface.

15. The method of playing a game of chance as recited in claim 10, wherein the set of playing pieces comprises at least one deck of cards.

* * * * *